US005820355A

United States Patent [19]

Ikeda et al.

[11] Patent Number: 5,820,355

[45] Date of Patent: Oct. 13, 1998

[54] SWASH PLATE TYPE COMPRESSOR

[75] Inventors: Hayato Ikeda; Hisato Kawamura; Hiromi Michiyuki; Masanobu Yokoi; Yasunori Ueda, all of Kariya, Japan

[73] Assignee: Kabushiki Kaisha Toyoda Jidoshokki Seisakusho, Japan

[21] Appl. No.: 561,953

[22] Filed: Nov. 22, 1995

[30] Foreign Application Priority Data

Nov. 25, 1994 [JP] Japan ..... 6-291766
Mar. 17, 1995 [JP] Japan ..... 7-059402

[51] Int. Cl.[6] ..... F04B 1/12

[52] U.S. Cl. ..... 417/269; 92/71

[58] Field of Search ..... 417/222.2, 222.1, 417/269; 92/71; 74/60

[56] References Cited

U.S. PATENT DOCUMENTS

| | | | |
|---|---|---|---|
| 3,057,545 | 10/1962 | Ransom et al. | 417/269 |
| 4,425,837 | 1/1984 | Livesay | 417/269 |
| 4,746,275 | 5/1988 | Iwamori et al. | 417/269 |
| 4,781,539 | 11/1988 | Ikeda et al. | 417/269 |
| 5,433,137 | 7/1995 | Ikeda et al. | 92/71 |

FOREIGN PATENT DOCUMENTS

| | | | |
|---|---|---|---|
| 4404637 A1 | 8/1994 | Germany . | |
| 590856 | 10/1959 | Italy | 417/269 |
| 63-174579 | 1/1988 | Japan . | |
| 3-26876 | 2/1991 | Japan | 417/269 |

*Primary Examiner*—Charles G. Freay
*Attorney, Agent, or Firm*—Woodcock Washburn Kurtz Mackiewicz & Norris LLP

[57] ABSTRACT

A compressor is described having front and rear cylinder blocks coupled to each other with a crank chamber defined therebetween. A swash plate is mounted on a drive shaft in the crank chamber. Double-headed pistons reciprocate in pairs of aligned cylinder bores. The swash plate divides the crank chamber into a plurality of sections. Holes formed in the swash plate permit flow of the refrigerant between the chamber sections. Recesses are formed radially inward and outward of a cam shoe contacting surface of the swash plate.

16 Claims, 12 Drawing Sheets

SWASH PLATE TYPE COMPRESSOR

BACKGROUND OF THE INVENTION

1. Field of the Invention

The present invention relates to an improvement in a swash plate type compressor which, for instance, may be employed in an air conditioning system for a vehicle.

2. Description of the Related Art

Compressors employed in automobiles and trucks are generally used to supply compressed gas to an air conditioning system of the vehicle. Among the various types of compressors used for such purposes is a swash plate type compressor provided with a plurality of double-headed pistons (refer to Japanese Unexamined Utility Model 63-174579). As shown in FIGS. 11 and 12, this compressor comprises a pair of cylinder blocks 111, 112 with a crank chamber 115 defined at the joint therebetween.

A drive shaft 125 is rotatably supported in the cylinder blocks 111, 112. A swash plate 130 mounted on the drive shaft 125 is disposed in the crank chamber 115. The swash plate 130 is interposed between the cylinder blocks 111, 112 via thrust bearings 128, 129. Pairs of aligned cylinder bores 131, 132 are formed about the drive shaft 125 in the cylinder blocks 111, 112. A double-headed piston 134, connected to the swash plate 130 via shoes 133, is reciprocally accommodated in each pair of bores 131, 132.

The width of the crank chamber 115 is designed with only a slight space between the swath plate 130 and an inner wall of the crank chamber 115 in order to make the compressor as compact as possible. Furthermore, the swash plate 130 substantially partitions the crank chamber 115 into two sections A and B. The sections A, B move as the swash plate 130 rotates.

FIG. 12 shows the rear cylinder block 112. A rear bore 132*a* is shown in a state where compression, or discharging, has been completed with respect to the rotation of the swash plate 130. Bores 132*b*, 132*c* are shown in a state where compression is being executed and bores 132*d*, 132*e* are shown in a state where suction is being executed. When the section A is in an expanded state, as shown in FIG. 11, the suction stroke is performed in the bores 132*d*, 132*e*. This allows refrigerant gas to be satisfactorily drawn into the bores 132*d*, 132*e* by way of a suction hole 135, the crank chamber 115, and suction passages 137*d*, 137*e*. When section A is contracted, or section B is expanded, the suction stroke is performed in the bores 132*a*–132*c*. Hence, refrigerant gas is drawn into the bores 132*a*–132*c* through suction passages 137*a*–137*c* after the refrigerant gas has flowed along the outer periphery of crank chamber 115 by the rotation of the swash plate 130 or after the gas flows around the swash plate 130 from section B to section A. Consequently, the swash plate 130 creates flow resistance and suction of refrigerant gas is thus limited.

Such suction imbalance among the rear bores 132*a*–132*e* also takes place in the front bores 131. There is a possibility that this will lead to a decreased compressing performance and may cause overheating or wear due to insufficient lubrication in certain bores.

In addition, there is a possibility that such imbalanced flow of gas within the crank chamber 115 may cause seizing or uneven wear of the shoes 133 and the swash plate 130 due to the difference in amount of lubricating oil, which is included in the refrigerant gas, applied between the swash plate 130 and each shoe 133.

Furthermore, in addition to the demand for a compressor with more compact size and lighter weight, there is also a demand for a compressor with lower vibration and noise.

SUMMARY OF THE INVENTION

The objective of the present invention is to provide a swash type plate compressor capable of improving imbalanced suction between each bore while having a smaller size and lighter weight.

To achieve the above objectives, a compressor according to the present invention includes front and rear cylinder blocks coupled to each other with a crank chamber therebetween. Front and rear housings, each having a suction chamber and a discharge chamber, serve to close the outer ends of the front and rear cylinder blocks. A drive shaft is supported in the front and rear cylinder blocks. A swash plate is mounted on the drive shaft in the crank chamber and is supported by the front and rear cylinder blocks with thrust bearings. Pairs of aligned bores are formed in the front and rear cylinder blocks. A double-headed piston reciprocates in each pair. Shoes slide along the outer surface of the awash plate during rotation of the swash plate to convert the rotation to a reciprocating movement of each piston. Reciprocation of each piston draws a refrigerant into the swash chamber from a suction hole and supplies the refrigerant to the bores via a plurality of suction passages and suction chambers defined in each cylinder block.

The swash plate partitions the crank chamber into a plurality of sections. A sliding section having a width which is narrower than the corresponding width of the shoe and corresponding to the suction stroke of the piston is defined on the swash plate. A recess is formed adjacent to the sliding section. A through hole defined at a position separated from the sliding section permits flow of the refrigerant between the partitioned sections.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

A first embodiment according to the present invention will now be described with reference to the drawings.

Figure 1:
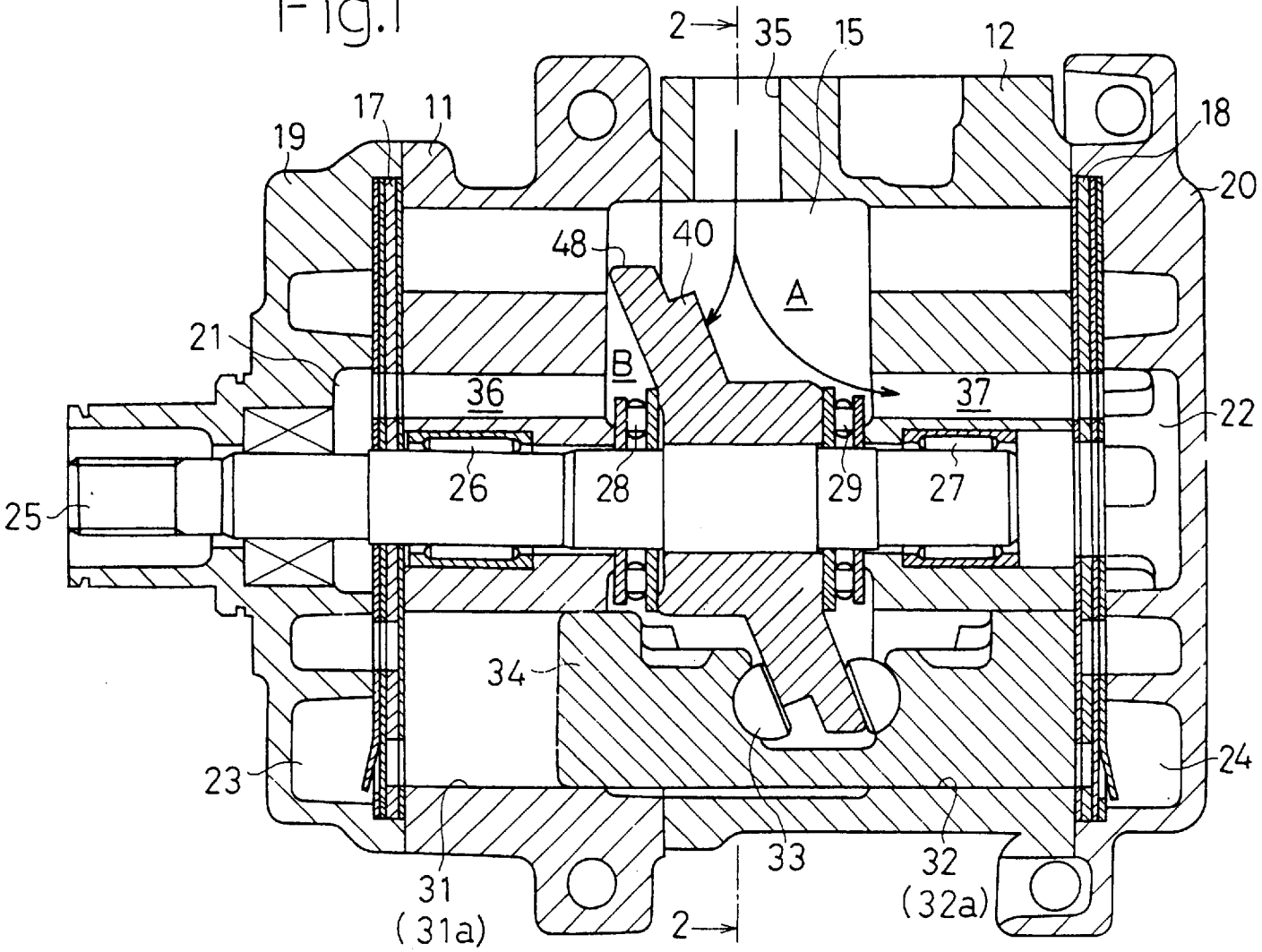
FIG. 1 is a cross-sectional view of a swash plate type compressor according to a first embodiment of the present invention.
Figure 2:
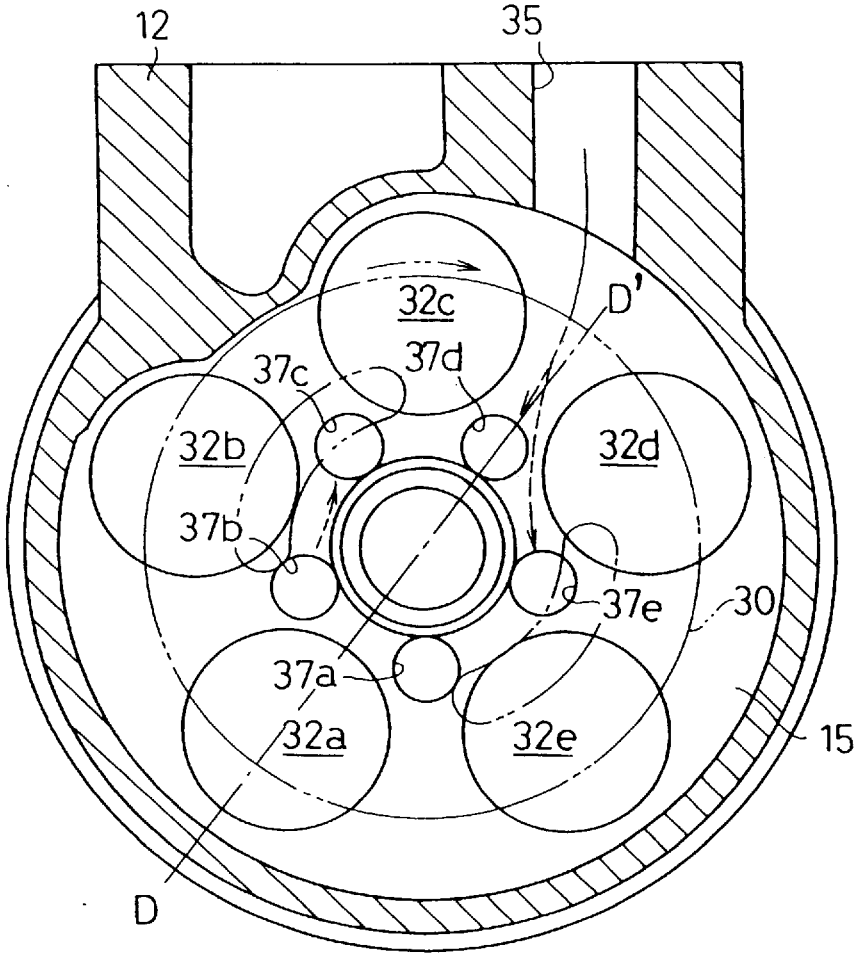
FIG. 2 is a cross-sectional view taken along line 2—2 of FIG. 1.

As shown in FIGS. 1 and 2, a compressor comprises a front cylinder block 11 and a rear cylinder block 12 and has a crank chamber 15 defined at the joint therebetween. Housings 19, 20 close the outer ends of the cylinder blocks 11, 12 with valve plates 17, 18, respectively. A suction chamber 21, 22 and a discharge chamber 23, 24 are defined in each housing 19, 20, respectively.

A drive shaft 25 is located in a shaft hole extending between the cylinder blocks 11, 12 and supported by radial bearings 26, 27. A swash plate 40 mounted on the drive shaft 25 is located inside the crank chamber 15 and is positioned between both cylinder blocks 11, 12 with thrust bearings 28, 29. Pairs of aligned cylinder bores 31, 32 are formed in the cylinder blocks 11, 12, respectively, about the drive shaft 25. A double-headed piston 34, connected to the swash plate 40 with shoes 33, is reciprocally accommodated in each pair of bores 31, 32.

A hole 35 for suction of refrigerant gas is formed in the wall of the crank chamber 15. Suction passages 36, 37, which communicate with the front and rear suction chambers 21, 22, are provided in the side walls of the crank chamber 15. Hence, the crank chamber 15 constitutes a part of a flow path for the refrigerant gas. The refrigerant gas includes hydro fluoro carbon, such as HFC-134*a* and HFC-152*a*. A lubricant, such as synthetic oil (PAG oil) in gaseous solution is mixed with the refrigerant gas. The combination of the refrigerant gas and the lubricant may be selected depending on the solubility of the lubricant into the refrigerant gas.

The width of the crank chamber 15 is designed with only a slight space between the swash plate 40 and the inner wall of the crank chamber 15 in order to make the compressor as compact as possible. Furthermore, the swash plate 40 substantially partitions the crank chamber 15 into substantially two sections A and B. The sections A, B move as the swash plate 40 rotates.

FIG. 2 shows the rear cylinder block 12. A rear bore 32*a* is shown in a state where compression, or discharging, has been completed. Bores 32*b*, 32*c* are shown in a state where compression is being executed and bores 32*d*, 32*e* are shown in a state where suction is being executed. When section A is in an expanded state, as shown in FIG. 1, the suction stroke is performed in the bores 32*d*, 32*e*. This allows refrigerant gas to be satisfactorily drawn into the bores 32*d*, 32*e* by way of the suction passages 37*d*, 37*e*. The suction stroke is performed in the bores 32*a*–32*c* when section A is contracted, or section B is expanded.

Figure 3:
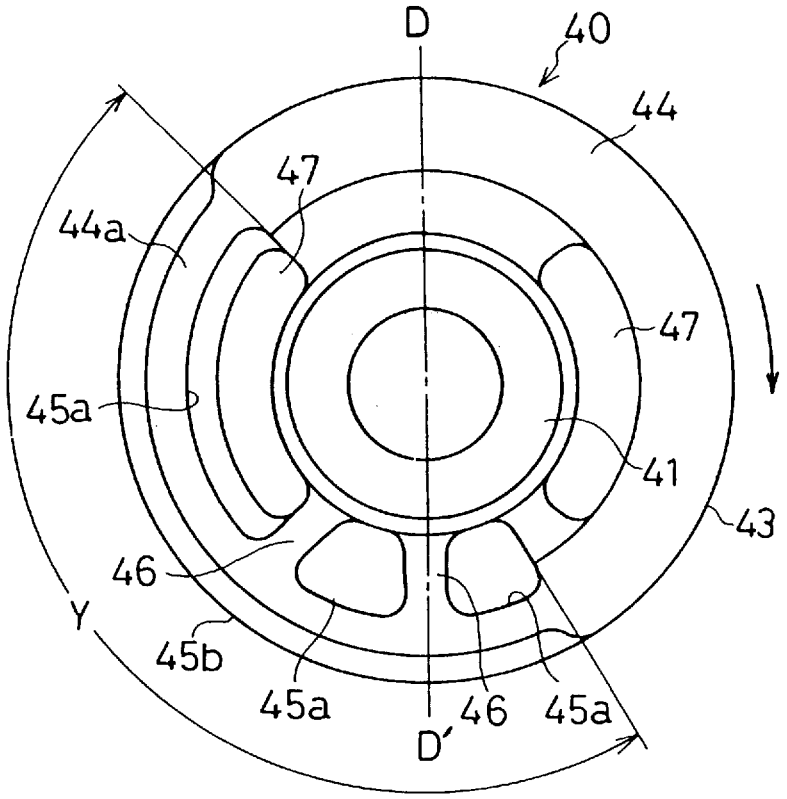
FIG. 3 is a front view of a swash plate employed in the compressor shorn in FIG. 1.
Figure 4:
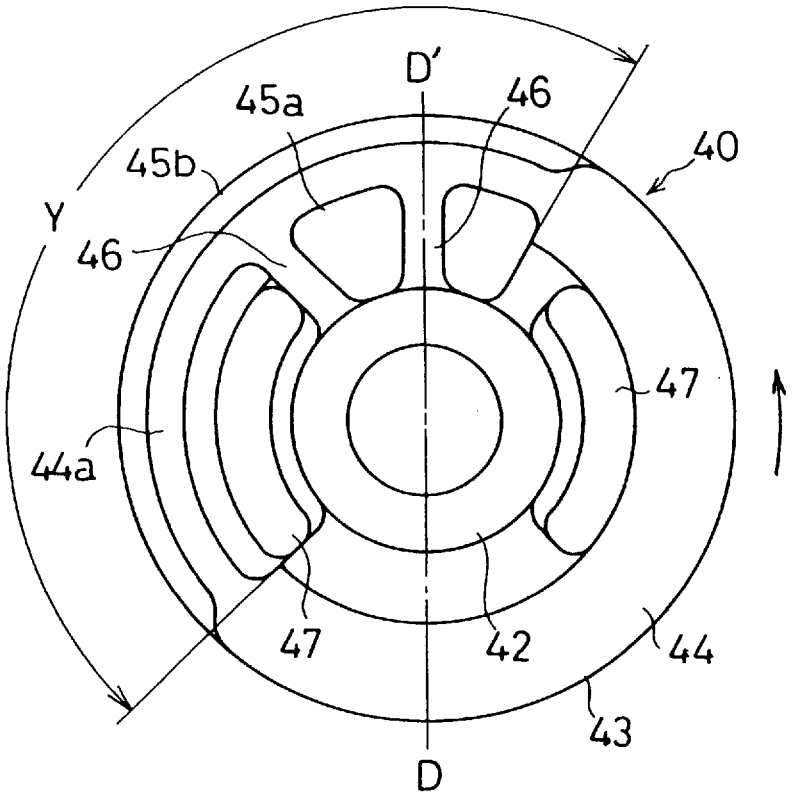
FIG. 4 is a rear view of the swash plate employed in the compressor shown in FIG. 1.
Figure 5:
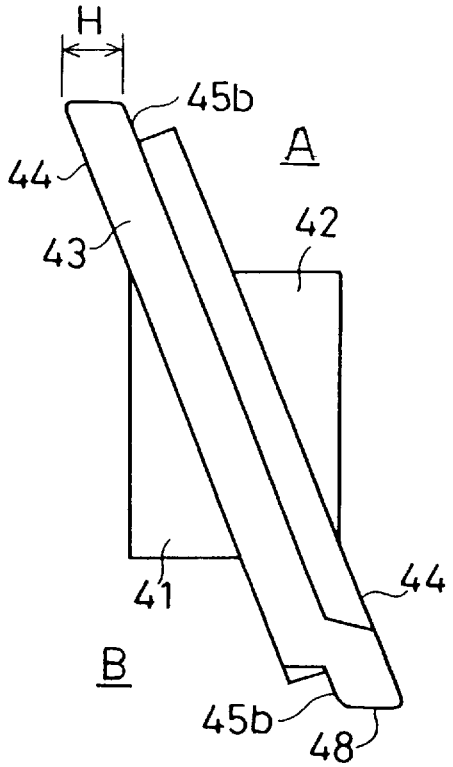
FIG. 5 is a side view of the swash plate employed in the compressor shown in FIG. 1.
Figure 6:
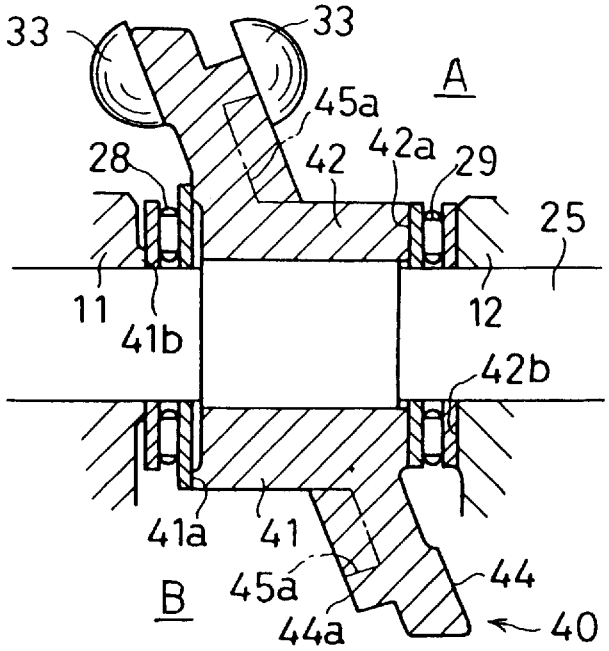
FIG. 6 is a cross-sectional view of the swash plate employed in the compressor shown in FIG. 1.

FIGS. 3, 4, and 5 show a front view, a rear view, and a side view of the swash plate 40, respectively. FIG. 6 is cross-sectional view showing the relation between the swash plate 40 and the sloes 33, and between the swash plate 40 and the thrust bearings 28, 29. As shown in FIGS. 3–6, the swash plate 40 includes front and rear boss portions 41, 42, which are provided with a fitting hole for the drive shaft 25, and a plate portion 43, which is formed integrally with the boss portions 41, 42 and inclined with respect to the axis of the swash plate 40. The plate portion 43 has two opposite parallel planar sides, each including a sliding surface 44 defined on the periphery of each side for contacting the shoes 33.

At an arc section Y of the swash plate 40 (FIG. 4), which substantially corresponds to the suction stroke of the pistons 34, a recess 45*a* is formed radially inward of the sliding surface 44, and a recess 45*b* is formed radially outward of the sliding surface 44. Thus, an annular belt region 44*a* is defined therebetween. The width of the belt region 44*a* in the radial direction is narrower than the corresponding width of each shoe 33. The belt region 44*a* is formed to enable contact with the center of each shoe 33 and is wide enough to prevent each shoe 33 from falling off. Reinforcing ribs 46, extending across the recess 45*a* towards the center axis from the belt region 44*a*, are provided on the swash plate 40. Each reinforcing rib 46 is formed to intersect an imaginary plane D–D', which intersects with points corresponding to the ends of the strokes of each piston 34 and the center axis of the swash plate 40. In FIG. 4, point D, or the 6 o'clock position, corresponds to the top dead center position of the piston head associated with the rear cylinder blocks 12. In addition, a pair of substantially symmetric and arc-shaped through holes 47 are formed inward of the sliding section 44. The through holes 47 are formed between a location which corresponds try the commencement of the suction stroke on one side of the swash plate 40 and a location which corresponds to the terminal stage of the suction stroke on the other side. Accordingly, the two sections A and B (refer to FIG. 5) inside the crank chamber 15, substantially partitioned by the swash plate 40, are communicated with each other by the through holes 47.

The through holes 47 are formed to partially align with the entrance of each suction passage 37 in order when the swash plate 40 rotates. For example, when the bore 32*e* is in the suction state and the bore 32*c* is in the compression state as shown in FIG. 2, one of the through holes 47 is aligned with the suction passage 37*e* and the other is aligned with the suction passage 37*c*.

As shown in FIG. 6, thrust bearings 28, 29 are disposed between each boss portion 41, 42 of the swash plate 40 and each supporting portion of the cylinder block 11, 12, respectively. In the same manner as the prior art, these thrust bearings 28, 29 are clamped between each boss portion 41, 42 and each associated cylinder block 11, 12 by the fastening force of bolts. Flat pressure seats 42*a*, 42*b* are formed on the rear boss portion 42 of the swash plate 40 and the supporting portion of the cylinder block 12, respectively. On the front boss portion 41 of the swash plate 40, an annular pressure seat 41*a* having a relatively large diameter is formed, and on the opposed supporting portion of the cylinder block 11, an annular pressure seat 41*b* having a relatively small diameter is formed. These pressure seats 41*a*, 41*b* apply a dampening function to the front thrust bearing 28 and permit elastic deformation of the bearing 28.

Figure 13:
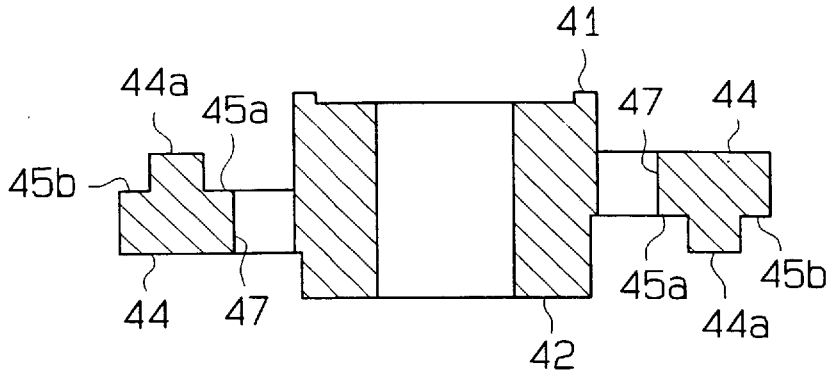
FIG. 13 is a cross sectional view of FIG. 3 on line 13—13.

Therefore, with the compressor of the present embodiment, refrigerant gas effectively flows via the through holes 47 (see FIG. 13) from one of the sections A, B, which is expanded in the vicinity of the suction hole 35, to the other section A, B, which is contracted. Accordingly, the length of the refrigerant gas flow path from the suction hole 35 to each suction passage 37 is shortened and the flow of refrigerant gas in each flow path is balanced. This allows flow resistance to be uniform throughout the compressor's cycle, Thus, an equal amount of refrigerant gas is smoothly drawn into each bore 31, 32.

Figure 10A:
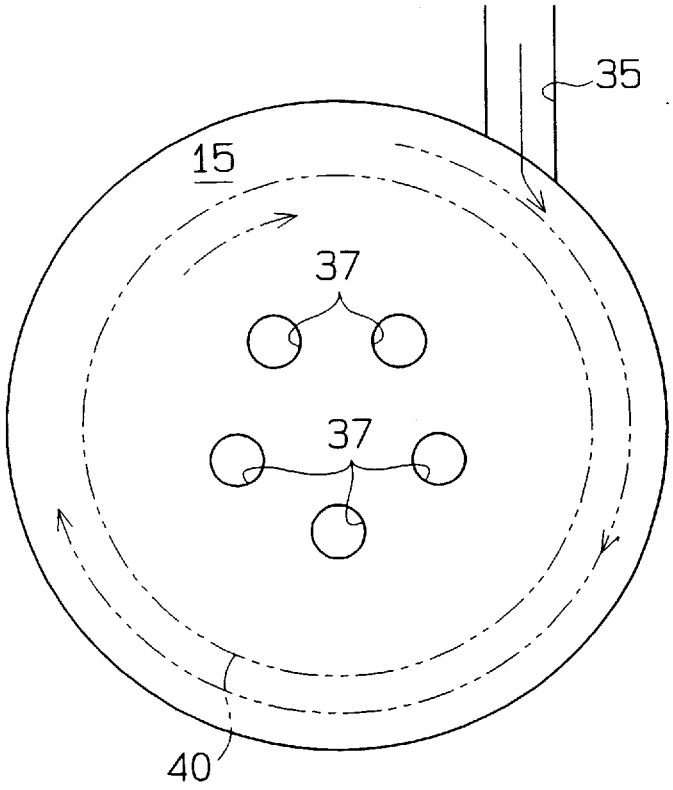
FIGS. 10(*a*), 10(*b*) and 10(*c*) schematically show refrigerant gas flows in a crank chamber.
Figure 10B:
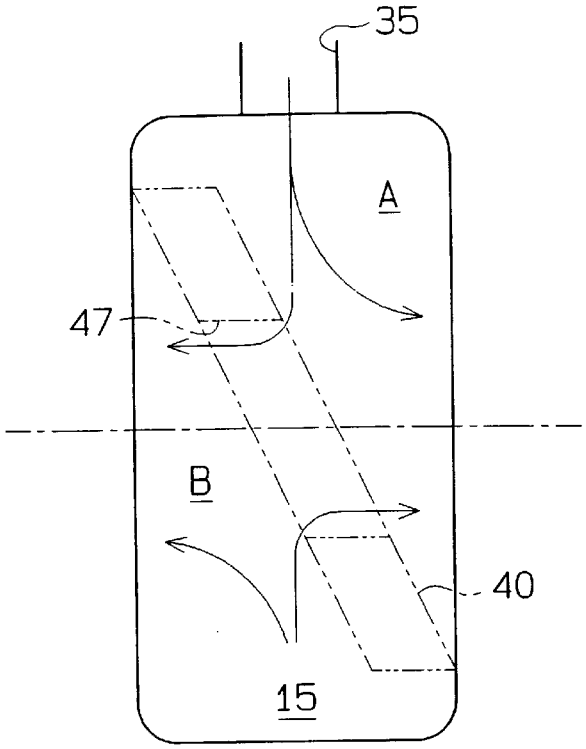
Figure 10C:
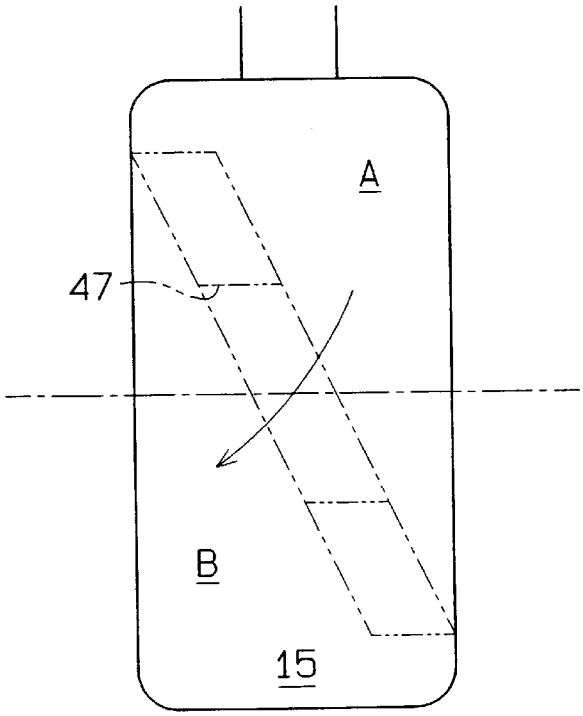
Figure 11:
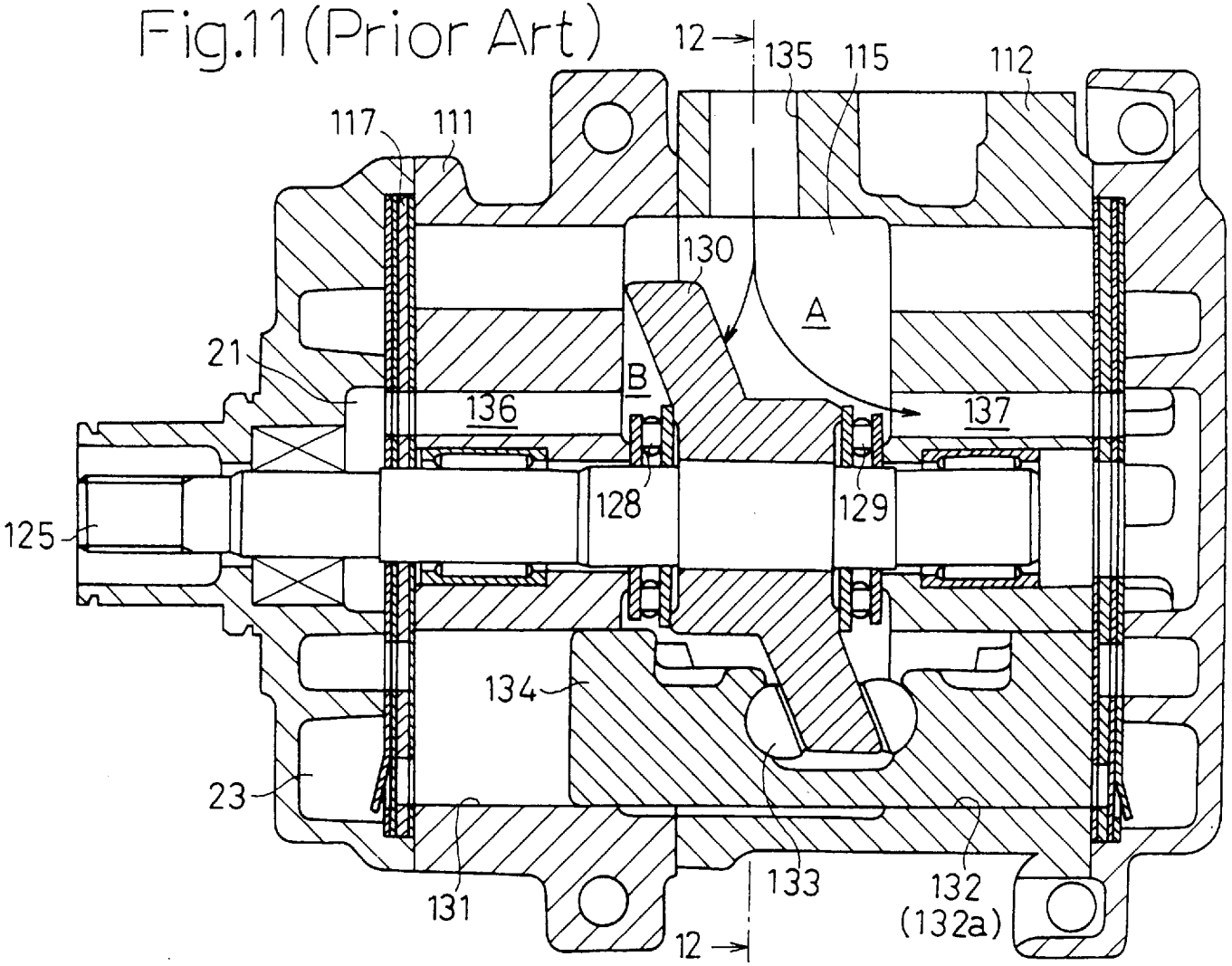
Fig.11 (Prior Art)
FIG. 11 is a cross-sectional view of a prior art compressor.
Figure 12:
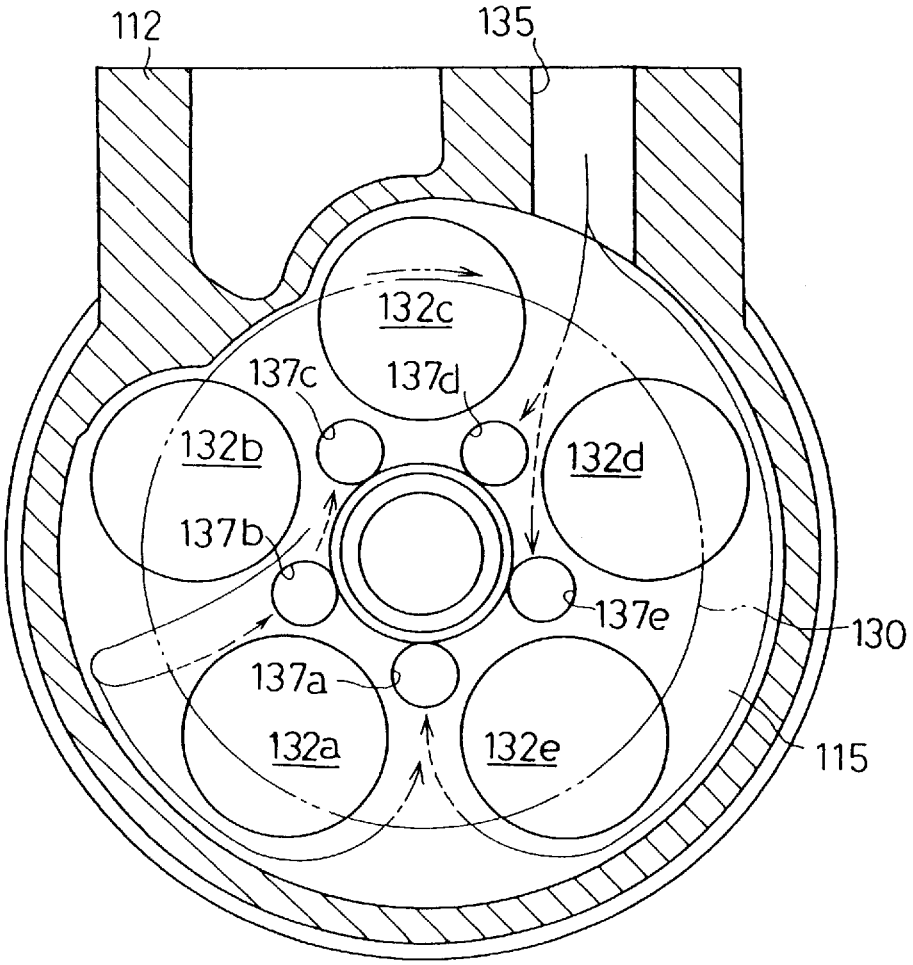
Fig.12(Prior Art)
FIG. 12 is a cross-sectional view of FIG. 11 on line 12—12.

As shown in FIG. 10(*a*), the refrigerant gas circulates along the swash plate 40 in the crank chamber 15 when the swash plate 40 rotates. This helps to uniformly supply the refrigerant gas and the lubricant to each suction passage 37. The inner wall of each through hole 47 shown in FIGS. 3 and 4 serves as a fin that stirs the refrigerant gas in the crank chamber 15 and divides the gas flow through the suction hole 35 into a plurality of gas flows in the axial direction of the shaft 25 toward each suction passage 37 as shown in FIG. 10(*b*). Accordingly, the through holes 47 help to uniformly supply the refrigerant gas to each suction passage 37. The through holes make gas flow that penetrates the swash plate 40 from the section A near the suction hole 35 to the section B away from the suction hole 35 as shown in FIG. 10(*c*). This contributes to uniformly distribute the refrigerant gas in the crank chamber 15 and to uniformly supply the refrigerant gas to each passage 37.

Furthermore, a wedge-like space defined between the shoe 33 and the annular belt region 44*a* causes stable formation of an oil film when the so-called wedge effect forces lubricant, adhered to the recess 45*a*, into the space during rotation of the swash plate 40. This leads to satisfactory lubrication between the shoes 33 and the swash plate 40. However, the recess 45*b* formed outward of the sliding surface 44 can be omitted if, without the recess, a part of the shoe extends beyond the circumferencial edge of the plate portion of the swash plate 40. In other words, the benefits of the wedge effect are obtained when part of the shoe extends beyond the edge of the belt region 44*a*, and a recess may be used to accomplish this if necessary.

The plate portion 43 of the swash plate 40 having the recesses 45*a*, 45*b* and the through hole 47 reduces the weight of the awash plate 40 and contributes to a lighter compressor. Despite the light weight, the reinforcing ribs 46 formed across the recesses 45*a* ensure sufficient strength of the swash plate 40. A sole reinforcing rib 46 may be formed on the plane D–D'.

In addition, the boss portions 41, 42 have different pressure seats 41*a*, 42*a* to apply a dampening function to one of the thrust bearings 28, 29 and rigidly clamp the other. This absorbs a tightening margin for assembly in the axial direction and effectively suppresses unstable vibrations of the swash plate 40.

Figure 7:
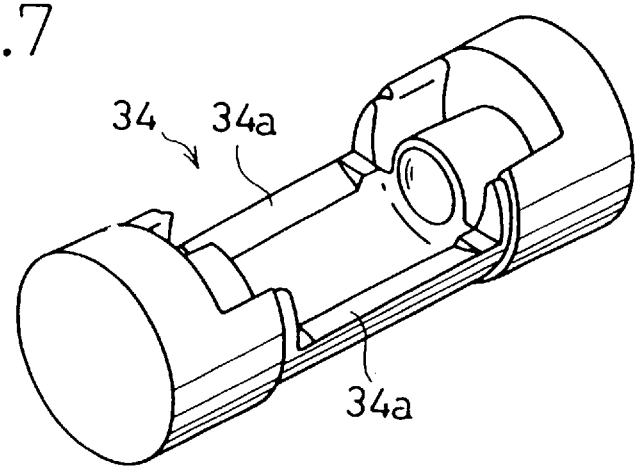
FIG. 7 is a perspective view of a piston employed in the compressor shown in FIG. 1.

Frictional force acting on each piston 34 via shoes 33 during rotation of the swash plate 40 causes slight rotation of the piston 34 about its axis. However, in this embodiment, a clearance surface 34*a* shown in FIG. 7 is formed at the middle of the piston 34. Engagement of the clearance surface 34*a* with the peripheral surface 48 of the swash plate 40 restricts the rolling of the piston 34. The sliding resistance between the swash plate 40 and the piston 34 results in a power loss. However, due to the outer recess 45*b*, the width H of the peripheral surface 48 is substantially reduced. As a result, the power consumption corresponding to the contact between the circumferential surface 48 and the clearance surface 34*a* is relatively small.

A second embodiment according to the present invention will be described hereafter with reference to FIGS. 8 and 9.

Figure 8:
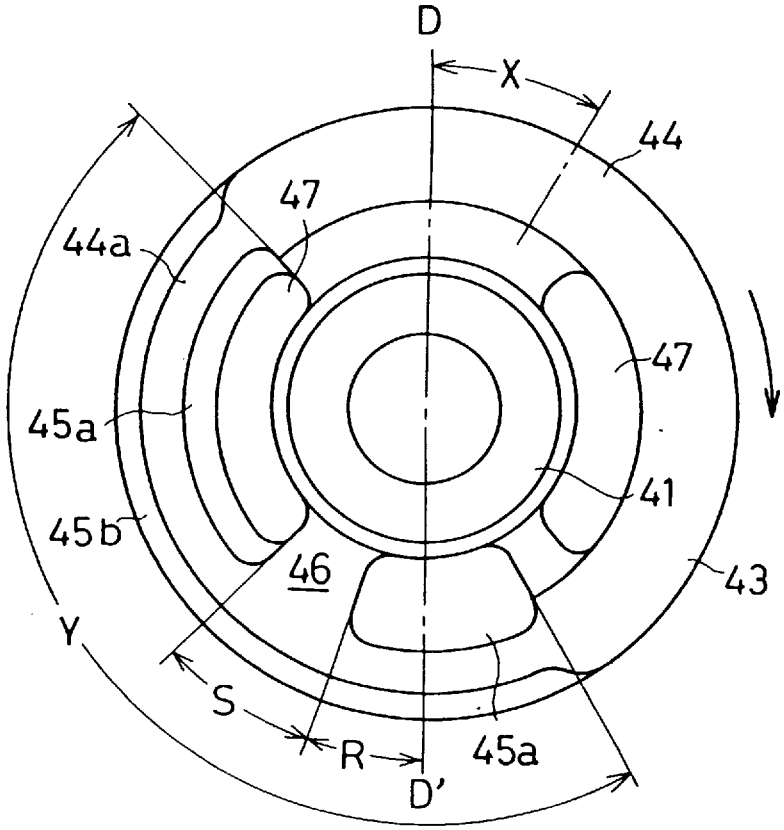
FIG. 8 is a front view of a swash plate according to another embodiment.
Figure 9:
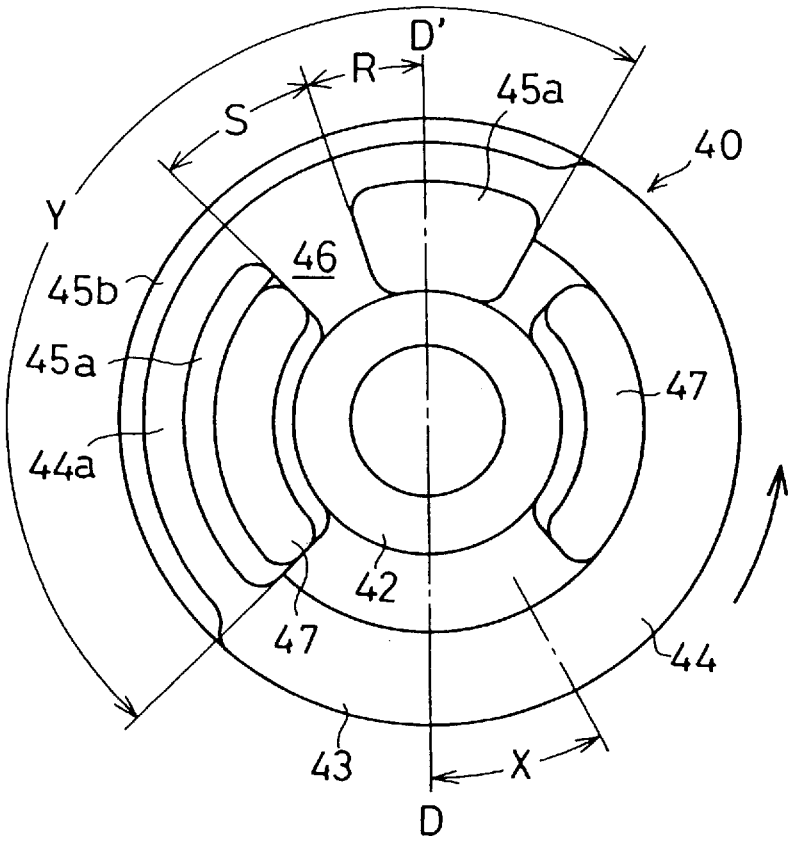
FIG. 9 is a rear view of a swash plate according to another embodiment.

FIGS. 8 and 9 show a front and a rear views of a swash plate 44, respectively. The construction of the swash plate 44 in this embodiment differs from the first embodiment in that the reinforcing ribs 46 are formed opposite to the location where the compressive reaction force is the highest. More specifically, each reinforcing rib 46 is formed within a section S. The section S starts from a place located R degrees (in this embodiment R degrees is about 10 degrees) away from the bottom dead center location D' in the rotational direction of the swash plate 40 (indicated by an arrow), and ends at a place further advanced for about 25 degrees. Furthermore, each reinforcing rib 46 extends across the inner recess 45*a* from the annular belt region 44*a* to the boss portions 41, 42.

Accordingly, in the same manner as in the first embodiment, a substantially equal amount of refrigerant gas is drawn into each bore 31, 32. Additionally, an oil film, which performs satisfactory lubrication, is reliably formed between the shoes 33 and the annular belt region 44*a*.

In addition, the recesses 45*a*, 45*b* and the through hole 47 reduce the weight of the swash plate 40. The reinforcing ribs 46 are formed on the diametrically opposite side of the swash plate 40 from a location corresponding to a discharge stroke X, shown in FIGS. 8 and 9, where the compressive reaction force reaches its highest level. This ensures sufficient strength of the swash plate 40.

Furthermore, in the same manner as in the first embodiment, a dampening function is applied to one of the thrust bearings 28, 29. Hence, a tightening margin for assembly is absorbed in the axial direction while unstable vibrations of the swash plate 40 are effectively suppressed.

In each embodiment, the swash plate 40 is made of aluminum. The depth of recesses 45*a* and 45*b* is set at about one half of the thickness of the plate portion of the swash plate 40. However, the depth or the number of recesses may vary depending on the material of swash plate 40.

Figure 14:
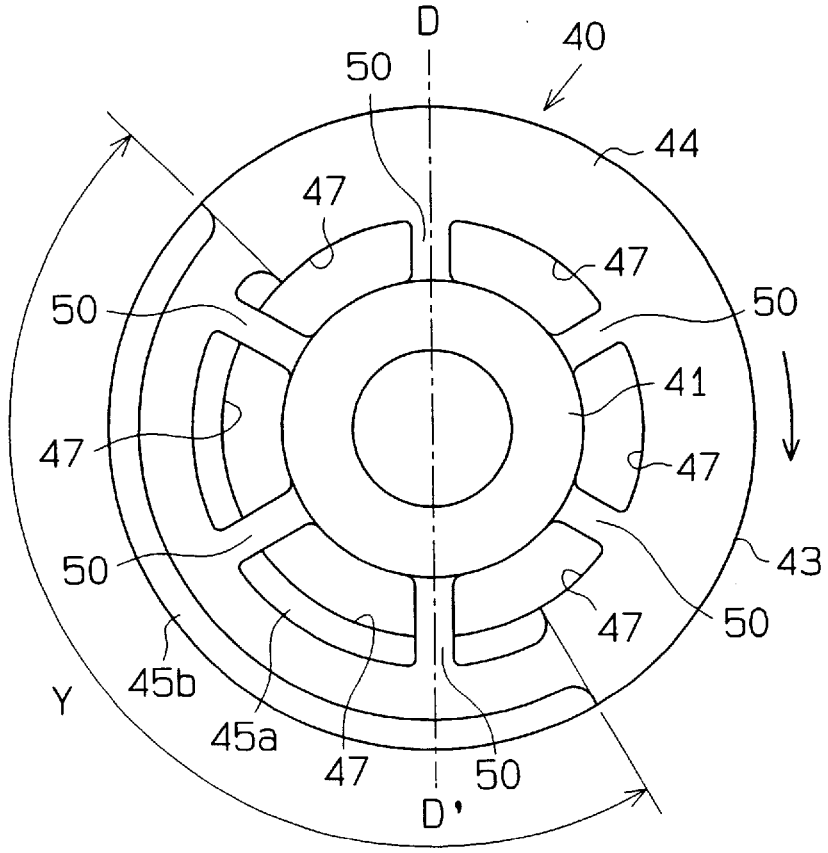
FIG. 14 is a rear view,of a swash plate according to a modified embodiment.

Each through hole is formed in an arc shape in the angle range of 90 degrees. However, the shape or the number of the through holes can be changed as required. For example, as shown in FIG. 14, a plurality of separations 50 that connect the opposite inner walls of the through hole 47 may be formed like in an aluminum wheel used for a tire of a car. These separations 50 may stir the refrigerant gas in the crank chamber and create gas flows in the axial direction of the compressor.

Although only two embodiments of the present invention have been described herein, it should be apparent to those skilled in the art that the present invention may be embodied in many other specific forms without departing from the spirit or scope of the invention. Therefore, the present examples and embodiments are to be considered as illustrative and not restrictive and the invention is not to be limited to the details given herein, but may be modified within the scope of the appended claims.

What is claimed is:

1. A swash plate type compressor having front and rear cylinder blocks coupled to each other with a crank chamber defined therebetween, front and rear housings, each having a suction chamber and a discharge chamber and serving to close the outer ends of the front and rear cylinder blocks, a drive shaft supported in the front and rear cylinder blocks, a swash plate mounted on the drive shaft in the crank chamber and supported by the front and rear cylinder blocks with thrust bearings, pairs of aligned bores formed in the front and rear cylinder blocks, a double-headed piston reciprocating in each pair, and shoes sliding along the outer surface of the swash plate during rotation of the swash plate to convert the rotation to a reciprocating movement of each piston, wherein each piston draws a refrigerant into the crank chamber from a suction hole in accordance with the reciprocation of each piston, and wherein the refrigerant is supplied to the bores via a plurality of associated suction passages and the suction chambers, said compressor including:

a plurality of sections of the crank chamber, which are partly defined by the swash plate;

a belt region defined on the swash plate to correspond to the suction stroke of the piston, said belt region having a width which is narrower than the corresponding width of each shoe; and said swash plate having a recess formed adjacent to a sliding surface defined on the swash plate and a through hole defined at a position separated from the sliding section, wherein said through hole permits flow of the refrigerant between the chamber sections.

2. A compressor according to claim 1, wherein two through holes are formed in the swash plate, one on each side of an imaginary plane that passes through positions on the sliding surface corresponding to the top dead center and bottom dead center positions of the pistons.

3. A compressor according to claim 1, wherein said recess is formed radially outward of the belt region and an additional recess is formed radially inward of the belt region.

4. A compressor according to claim 3 further comprising a reinforcing rib crossing the recess and located inward of the belt region and extending from the belt region toward the center axis.

5. A compressor according to claim 4, wherein said reinforcing rib is located at a position corresponding to a plane intersecting the axis of the swash plate and passing through points on the swash plate corresponding to top dead center and bottom dead center positions of the pistons.

6. A compressor according to claim 4, wherein said swash plate has a first area which receives the highest compressive reaction force, said reinforcing rib being formed on a second area diametrically opposite to the first area.

7. A compressor according to claim 1, wherein said swash plate has a plate portion and a pair of bosses protruding from opposite sides of the plate portion, one of the bosses including a pressure receiving seat having annular ring shape with a relatively large diameter opposing an annular seat associated with the corresponding cylinder block having a relatively small diameter for applying a dampening function to the thrust bearings.

8. The compressor according to claim 1, wherein said through hole partially aligns with the entrance of each suction passage when the swash plate rotates.

9. A swash plate type compressor having front and rear cylinder blocks coupled to each other with a crank chamber defined therebetween, front and rear housings each having a suction chamber and a discharge chamber and serving to close the outer ends of the front and rear cylinder blocks, a drive shaft supported in the front and rear cylinder blocks, a swash plate mounted on the drive shaft in the crank chamber and supported by the front and rear cylinder blocks via front and rear thrust bearings, pairs of aligned bores formed in the front and rear cylinder blocks, a double-headed piston reciprocating in each bore, and shoes sliding along the outer surface of the swash plate during rotation of the swash plate to convert the rotation to a reciprocating movement of each piston, wherein said pistons draw a refrigerant into the crank chamber from a suction hole in accordance with the reciprocation of each piston and wherein the refrigerant is supplied to the bores via a plurality of suction passages and the suction chambers, said compressor including:

said swash plate dividing the crank chamber into a plurality of sections;

a front boss and a rear boss each protruding from the plate portion, one of the bosses including a pressure receiving seat having an annular ring shape that is misaligned with an annular seat associated with the corresponding cylinder block;

a belt region defined on the plate portion to correspond to the suction stroke of the piston, and said belt region having a width narrower than the corresponding width of each shoe; and said swash plate having a recess formed adjacent to a sliding surface defined on the swash plate and a through hole defined at a position separated from the sliding section, wherein said through hole permits flow of the refrigerant between the chamber sections.

10. A compressor according to claim 9, wherein said through hole is formed on the opposite sides of an imaginary plane that passes through a top dead center position, a bottom dead center position and a center axis of the swash plate.

11. A compressor according to claim 9, wherein said recess is formed outward of the belt region and an additional recess is formed inward of the belt region.

12. A compressor according to claim 11 further comprising a reinforcing rib crossing the recess located inward of the belt region and extending from the belt region towards the center axis.

13. A compressor according to claim 12, wherein said reinforcing rib is located along a plane passing through a top dead center position of the swash plate, a bottom dead center position and the center axis of the swash plate.

14. A compressor according to claim 12, wherein said swash plate has a first area which receives the highest compressive reaction force, said reinforcing rib is formed on a second area diametrically opposed to the first area.

15. The compressor according to claim 9, wherein said through hole partially aligns with the entrance of each suction passage when the swash plate rotates.

16. A swash plate type compressor comprising:

a pair of cylinder blocks with a crank chamber defined therebetween, the crank chamber including a suction hole;

a plurality of cylinder bores formed in the cylinder bores;

a drive shaft;

a swash plate connected to the drive shaft for rotation and occupying the crank chamber such that the swash plate divides the crank chamber into two parts;

a plurality of double-headed pistons fitted in the cylinder blocks;

a plurality of shoes contacting the pistons and the swash plate to convert rotation of the swash plate to reciprocating movement of the pistons;

the swash plate having sliding sections which contact the shoes;

wherein the reciprocation of the pistons draws refrigerant into the crank chamber through the suction hole and wherein the refrigerant is subsequently drawn into the cylinder bores;

said swash plate having a hole formed through it radially inward of the sliding sections such that refrigerant is allowed to flow through the hole from one of the two chamber parts to the other;

wherein each shoe has a swash plate-contacting surface and at least a portion of each sliding section in the belt region of the swash plate is narrower than the corresponding dimension of the corresponding shoes such that a part of the swash plate-contacting surface of each shoe loses contact with the swash plate during a portion of each cycle of the compressor.

* * * * *